United States Patent [19]

Barbetta et al.

[11] Patent Number: 4,539,284

[45] Date of Patent: Sep. 3, 1985

[54] DEVELOPER COMPOSITIONS WITH INFRARED ABSORBING ADDITIVES

[75] Inventors: Angelo J. Barbetta, Penfield; Robert J. Gruber, Pittsford; Louis V. Isganitis, Rochester; Kock-Yee Law, Fairport; John W. Lin, Webster; Ronald J. Koch, Rochester; Steven T. Dunn, Webster, all of N.Y.

[73] Assignee: Xerox Corporation, Stamford, Conn.

[21] Appl. No.: 600,854

[22] Filed: Apr. 16, 1984

[51] Int. Cl.[3] ..... G03G 9/10

[52] U.S. Cl. ..... 430/110; 430/944; 430/124

[58] Field of Search ..... 430/110, 124, 944, 353

[56] References Cited

U.S. PATENT DOCUMENTS

| | | | |
|---|---|---|---|
| 3,377,286 | 4/1968 | Stricklin | 430/126.6 |
| 3,632,617 | 1/1972 | Suzuki et al. | 430/107 |
| 3,640,863 | 2/1972 | Okuno et al. | 252/62.1 |
| 3,816,118 | 6/1974 | Byrne | 96/1.5 |
| 3,821,113 | 6/1974 | Morikawa et al. | 252/62.1 |
| 3,825,422 | 7/1974 | Gruber et al. | 96/1 PE |
| 3,900,589 | 8/1975 | Lindblad et al. | 427/19 |
| 4,021,358 | 5/1977 | Tomono et al. | 430/109 X |
| 4,040,970 | 8/1977 | Tsuneda | 252/62.1 |
| 4,126,565 | 11/1978 | Lenhard et al. | 430/106 X |
| 4,229,512 | 10/1980 | Lenhard et al. | 430/110 X |
| 4,415,639 | 11/1983 | Horgan | 430/58 X |
| 4,433,040 | 2/1984 | Niimura et al. | 430/110 X |

FOREIGN PATENT DOCUMENTS 5245931 9/1975 Japan .

*Primary Examiner*—John D. Welsh

*Attorney, Agent, or Firm*—E. O. Palazzo

[57] ABSTRACT

An improved infrared sensitive flash fusible colored toner composition comprised of (1) resin particles, (2) pigment particles selected from the group consisting of cyan, magenta, yellow, blue, red and green, and (3) additives selected from the group consisting of vanadyl phthalocyanines, naphthalocyanines, and the quaternary ammonium salts selected from the group consisting of 1,1',3,3,3',3 hexylmethyl-4,4',5,5'-dibenzo-2,2'-indotricarbocyanine perchlorate, 5,5'-dichloro-11-diphenylamine-3,3'-diethyl-10,12-ethylenethiatricarbocyanine perchlorate, 1,1',3,3,3',3'-hexamethylindotricarbocyanine perchlorate, and 3,3'-di(3-acetoxypropyl)-11-diphenylamine-10,12-ethylene-5,6,5',6'-dibenzothiatricarbocyanine perchlorate.

24 Claims, No Drawings

DEVELOPER COMPOSITIONS WITH INFRARED ABSORBING ADDITIVES

BACKGROUND OF THE INVENTION

This invention is generally directed to toner and developer compositions, and more specifically the present invention is directed to colored toner compositions, and colored developer compositions, containing therein infrared absorbing additives, or infrared absorbing colorants. In one embodiment, the present invention is directed to colored toner particles suitable for flash fusing systems, wherein the particles contain therein infrared absorbing additive substances including various phthalocyanine compositions, and other compositions. In one variation of the present invention there is provided infrared absorbing additives for color toners, wherein the additive also functions as a charge enhancing substance. The toner and developer compositions of the present invention are especially useful for causing the development of images in electrostatic imaging systems, particularly those systems having incorporated therein a flash fusing device.

The formation and development of images on the surface of electrophotographic materials, referred to in the art as photoreceptors for example, by electrostatic means is well known, these processes involving subjecting the photoconductive material to a uniform charge, and subsequently exposing the surface thereof to a light image of the original to be reproduced. The latent image formed on the xerographic photoconductive surface is developed with toner particles specifically prepared for this purpose. Thereafter the develped image can be transferred to a final support material such as paper, and affixed thereto in order to obtain a permanent record or copy of the original. Numerous methods are known for applying the electrostatic toner particles to the electrostatic latent image, including for example, cascade development, magnetic brush development, powder cloud development, and touchdown development.

The image formed can be fixed by a number of various well known techniques including, for example, vapor fixing, heat fixing, pressure fixing, or combinations thereof, as described for example in U.S. Pat. No. 3.539,161. These techniques of fixing while suitable for certain purposes suffer from some deficiencies, thereby rendering their use either impractical or difficult for specific electrostatographic applications. For example, it is difficult to construct an entirely satisfactory heat fuser which has high efficiency, can be easily controlled, and has a desirable short warm-up time. Also, heat fusers sometimes burn or scorch the support material. Somewhat similar problems including for example, image offsetting and undesirable resolution degradation, are present with pressure fusing methods. Additionally with these processes, consistently desirable permanent images are not obtained. Vapor fixing has advantages, however, one of its main disadvantage is that a toxic solvent is used, therefore in many situations this method becomes commercially unattractive in view of health hazards associated therewith. Also, equipment and apparatus to sufficiently isolate the fuser from the surrounding area is very complex, costly, and difficult to operate.

Many of the modern electrostatographic reproducing apparatuses, which are capable of producing copies at an extremely rapid rate, created the need for the development of new materials and processing techniques. With these systems, radiant flash fusing is one of the preferred fixing processes selected in that the energy which is emitted in the form of electromagnetic waves is immediately available and requires no intervening medium for its propogation. Although an extremely rapid transfer of energy between the source and the receiving body is provided with the flash fusing process, a problem encountered with this process resides in obtaining an apparatus which can fully and efficiently utilize a preponderance of the radiant energy emitted by the source during a relatively short flash. The toner image in these systems usually comprises a relatively small percentage of the total area of the copy receiving the radiant energy, causing most of the energy generated to be wasted as it is transmitted to the image, or is reflected away from the fusing areas. Furthermore, many of the toner compositions currently available, particularly colored toner compositions, contain pigments which do not absorb energy in the near infrared region of the spectrum, thereby necessitating the supply of larger amounts of energy to these compositions in order to effect fusing. Moreover, many of the known colored toner compositions contain pigments therein which do not absorb energy in the near infrared and/or ultraviolet region of the spectrum, thus only about 33 percent of the spectral energy generated for example, from presently used Xenon lamps is undesirably absorbed by the colorants contained in the toner composition.

Generally, radiation energy emitted from a Xenon flash lamp, or similar source, is absorbed by the pigment or dye contained in the toner composition, and thereafter this energy is convered to thermal energy by a radiationless decay process enabling heat generation, causing the toner particles to fuse. The flash energy used is absorbed in a layer of toner of finite thickness adjoining the outer toner surface, with absorption being greatest at the surface. This energy also constantly decreasing with increasing distance from the outer toner surface. The flash generated is of very short duration, on the order of about one millisecond, and consequently the toner regions very close to the surface are heated to a much higher temperature than the toner mass as a whole.

Examples of known flash fusing systems that may be selected for the present invention, includes those as described in U.S. Pat. Nos. 3,529,125; 3,903,394; and 3,474,223; the disclosure of each of these patents being totally incorporated herein by reference. Generally, the flash fuser selected contains a Xenon lamp, the output of the lamp being primarly in the visible and near infrared wavelengths of the regions. The output of the flash lamp is measured by Joules using the capacitor bank energy in accordance with the formula $\frac{1}{2}CV^2$ wherein C is capacitance and V is the voltage. One of the main advantages of such a flash fuser over other known methods of fusing is, as indicated herein, that the energy propagated in the form of electromagnetic waves is immediately available, and no intervening source is needed. Also, such flash fusing systems do not require long warm-up periods, and the energy does not have to be transferred through a relatively low conductive or corrective heat transfer mechanism.

Furthermore, many of the color developer compositions selected for use in flash fusing systems do not possess high toner fusion efficiency, and do not absorb light in both the visible and infrared region of the spectrum. Moreover, in view of the intensity of the flash radiation supplied to the toner composition, the higher temperature generated in the toner causes decomposition thereof and the undesirable volatile material that is formed cannot be absorbed or entrapped by the decomposed toner matrix. This material thus escapes from the toner layer before the toner can cool. A toner composition with high thermal stability, such as several of the color toners of the present invention, will substantially eliminate this problem. Also, the toner compositions of the present invention contain pigments which absorb energy in the infrared and ultraviolet light region of the spectrum, enabling these compositions to absorb light from infrared emitting devices including commercially available Xenon lamps. Additionally, many of the pigments used in the toner compositions of the present invention can function simultaneously as an infrared absorbing component, and a charge enhancing material.

SUMMARY OF THE INVENTION

It is an object of the present invention to provide a colored toner composition which overcomes the above-noted disadvantages.

In a further object of the present invention, there are provided colored toner compositions containing additives which absorb energy in the visible, and near infrared region of the spectrum.

In still a further object of the present invention, there are provided colored toner compositions containing phthalocyanine additives which absorb energy in the near infrared region of the spectrum.

In a further object of the present invention there are provided colored toner compositions containing quaternary ammonium salt additives and amines that absorb energy in the near infrared or ultraviolet region of the spectrum, and also simultaneously function as charge enhancing additives.

Another object of the present invention resides in the provision of colored developer compositions which when used in an electrostatographic imaging system containing a flash fusing energy source produce high quality colored images.

Yet another object of the present invention resides in the provision of colored developer compositions containing as infrared absorbing additives vanadyl phthalocyanines, certain naphthalocyanines, selected quaternary ammonium salts and various amine compositions.

Additionally, a further object of the present invention resides in the provision of colored developer compositions containing quaternary ammonium salt additive compositions, and amine additive compositions, which compositions absorb energy in the infrared region of the spectrum, and simultaneously function as charge enhancing additives.

A further object of the present invention resides in the provision of toner compositions and developer compositions useful in colored xerographic imaging systems, wherein the compositions contain therein near infrared and/or ultraviolet absorbing materials, in addition to colorants and charge enhancing components.

These and other objects of the present invention are accomplished by the provision of a colored developer composition containing therein additives which absorb light generated in the near infrared region of the spectrum, and wherein certain of the additives in some instances function as the colorant for the toner composition.

More specifically, in one embodiment of the present invention there are provided colored toner compositions comprised of resin particles, pigment particles, and infrared absorbing additives. Specifically, one preferred toner composition of the present invention is comprised of resin particles, pigment particles, and as infrared absorbing additive components, certain phthalocyanine compositions, quaternary ammonium salts, and amines as disclosed hereinafter. The quaternary ammonium salts, and the amine component additives can function simultaneously as near infrared absorbing additives, and as charge control agents, for the toner composition. Specifically, in one preferred embodiment, the present invention is directed to an improved infrared sensitive colored toner composition comprised of resin particles, pigment particles of cyan, magenta, yellow, blue, red or green, and additives selected from the group consisting of vanadyl phthalocyanines, naphthalocyanines including metallonaphthalocyanines, and the quaternary ammonium salts 1,1',3,3,3',3 hexylmethyl-4,4',5,5'-dibenzo-2,2'-indotricarbocyanine perchlorate, 5,5'-dichloro-11-diphenylamine-3,3'-diethyl-10,12-ethylenethia-tricarbocyanine perchlorate, 1,1',3,3,3',3'-hexamethylindotricarbocyanine perchlorate, 3,3'-di(3-acetoxypropyl)-11-diphenylamine-10,12-ethylene-5,6,5',6'-dibenzothiatricarbocyanine perchlorate; and 2-(1-naphthyl)-5-phenyloxazole.

Examples of phthalocyanine additives selected for incorporation into the color toner compositions of the present invention include vanadyl phthalocyanines, metalonaphthalocyanines, such as tetra-tertiarybutyl vanadyl naphthalocyanine, vanadyl napthalocyanine, and the like; tetrabutylalkyl vanadyl phthalocyanines, especially those wherein the alkyl group contains from about 1 to about 6 carbon atoms, including methyl, ethyl, propyl, butyl, tertiary butyl, hexyl and the like; while examples of quaternary ammonium salt compositions are selected from the group consisting of 1,1',3,3,3',3 hexylmethyl-4,4',5,5'-dibenzo-2,2'-indotricarbocyanine perchlorate, 5,5'-dichloro-11-diphenylamine-3,3'-diethyl-10,12-ethylenethiatricarbocyanine perchlorate, 1,1',3,3,3',3'-hexamethylindotricarbocyanine perchlorate, 3,3'-di(3-acetoxypropyl)-11-diphenylamine-10,12-ethylene-5,6,5',6'-dibenzothiatricarbocyanine perchlorate, and the like.

The additives of the present invention can be incorporated into the toner composition in various suitable effective amounts, however, generally from about 0.1 percent by weight to about 20 percent by weight, and preferably from about 0.5 percent by weight to about 5 percent by weight of additive is present, especially when the additive is functioning as a charge enhancing component, and as a material which absorbs energy in the near infrared region of the spectrum. By charge enhancing additive in accordance with the present invention is meant enhancing or imparting a specific charge, such as a positive charge to the toner resin particles. Thus, for example, the quaternary ammonium salt compositions when incorporated into the developer composition of the present invention impart a positive charge to the toner resin particles, enabling their use in electrostatographic imaging systems, wherein an organic photorecepter composition, which has been negatively charged, is situated.

The near infrared absorbing additives of the present invention can also be substituted for the colorant or pigment materials, such as the cyan pigments contained in the colored developer compositions. In this embodiment the additives of the present invention are present in an effective amount; generally from about 0.1 percent to about 5 percent by weight, and preferably in an amount of from about 1 percent to about 3 percent by weight, based on the weight of the toner resin particles.

The toner composition of the present invention can be prepared by various known suitable methods including melt blending followed by grinding or spray drying. Thus, the toner particles can be prepared by melt blending the toner resin particles, the pigment particles and the additive components illustrated hereinbefore, for a sufficient time period so as to obtain a uniform mixture of these materials. Subsequently, the resulting mixture is subjected to a mechanical attrition process in a suitable apparatus, such as a rubber mill, followed by attriting the toner particles, and classification. As a result there are obtained toner particles ranging in diameter of from about 0.5 microns to about 50 microns, and preferably from about 5 microns to about 25 microns.

Other methods include dispersion polymerization methods wherein a solvent dispersant of resin particles, pigment particles, and the additive components of the present invention are spray dried under controlled conditions resulting in the desired product; extrusion, and the like.

Illustrative examples of toner resins useful for incorporation into the toner composition of the present invention include numerous known suitable resins such as polyesters; polymers of styrene/butadiene, styrene/methacrylate, styrene and acrylate; polyamides, epoxies, polyurethanes, vinyl resins and polymeric esterification products of a dicarboxylic acid and a diol comprising a diphenol. Suitable vinyl resins include homopolymers or copolymers of two or more vinyl monomers. Typical examples of vinyl monomeric units include: styrene, p-chlorostyrene vinyl naphthalene, vinyl chloride, vinyl bromide, vinyl fluoride, ethylenically unsaturated monoolefins such as ethylene, propylene, butylene, isobutylene and the like; vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

The preferred toner resins of the present invention are selected from polystyrene methacrylate resins, polyester resins including those described in U.S. Pat. No. 3,655,374, the disclosure of which is totally incorporated herein by reference, polyester resins resulting from the condensation of dimethylterephthalate, 1,3 butanediol, and pentaethythriol, and Pliolite resins which are commercially available from Goodyear Corporation as S5A. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent by weight of styrene, and 11 percent by weight of butadiene.

The toner resin particles are present in the toner composition in an amount enabling a total of about 100 percent for all components. Generally, the toner resin is present in an amount of from about 60 percent by weight to about 90 percent by weight, and preferably from about 75 percent by weight to about 85 percent by weight. In one preferred embodiment, the toner composition of the present invention is comprised of 90 percent by weight of resin particles, 5 percent by weight of pigment particles, and 5 percent by weight of the infrared absorbing additives disclosed herein. Other preferred embodiments include toner compositions comprised of about 88 percent by weight of resin particles, 10 percent by weight of pigment particles or colorants, and 2 percent by weight of the near infrared absorbing material illustrated herein. In a very preferred embodiment, when the additives of the present invention are present in the toner composition for the purpose of functioning both as a charge enhancing additive and as a near infrared absorber the toner composition involved is comprised of about 85 percent by weight of resin particles, about 5 percent by weight of pigment particles or colorants, and about 10 percent by weight of the additive components illustrated hereinbefore.

As pigment particles the colored toner composition of the present invention contains various known cyan pigments, magneta pigments, yellow pigments, red pigments, green pigments, or blue pigments, and mixtures thereof. Illustrative examples of cyan pigments include copper tetra-4-(octadecylsulfonomido) phthalocyanine, the X-copper phthalocyanine pigment listed in the color index as CI 74160, CI Pigment Blue 15, an Anthradanthrene blue identified in the color index as CI 61890, Special Blue X-2137 and the like; while illustrative examples of yellow pigments that may be selected include diarylide yellow 3,3-dichloro benzidene acetoacetanilide a monoazo pigment identified in the color index as CI 12700, CI Solvent Yellow 16, a nitrophenyl amine sulfonamide identified in the color index as Foron Yellow SE/GLF, CI Dispersed Yellow 33, 2,5-dmethoxy-4-sulfonoanilide phenylazo-4-chloro2,5- dimethoxy acetoacetanilide, permanent yellow FGL, and the like. Illustrative examples of magenta materials that may be selected as pigments, include for example, 2,9-dimethyl substituted quinacridone and anthraquinone dye identified in the color index as CI 60710, CI Dispersed Red 15, a diazo dye identified in the color index as CI 26050, CI Solvent Red 19, and the like.

Certain additive components of the present invention, such as the vanadyl phthalocyanines can also function as colorants. Specifically, vanadyl phthalocyanine can be substituted as the cyan pigment in a colored toner composition while simultaneously functioning as near infrared absorbing additive. In this embodiment, the vanadyl phthalocyanine is usually present in the toner composition in an amount of from about 1 percent by weight to about 15 percent by weight and preferably from about 3 percent by weight to about 7 percent by weight. Examples of other additives of the present invention which can also simultaneously function as near infrared absorber and as a substitute for the colored pigments, particularly the cyan pigments, include x-metal free phthalocyanine, chloroaluminum phthalocyanines, and the like.

Illustrative examples of carrier materials selected for incorporation into the developer composition of the present invention include those materials that are capable of triboelectrically attaining a charge of opposite polarity to that of the toner particles including, for example, glass, steel, nickel, iron ferrites, silicone dioxide, and the like. These carriers can be used with or without a coating. Examples of coatings are comprised of fluoropolymers, including polyvinylidene fluoride commercially available from Pennwalt Chemical Co., and terpolymers of styrene, methacrylates, and silanes. Additionally there can be selected nickel berry carriers as described in U.S. Pat. Nos. 3,847,604 and 3,767,598, which carriers are nodular beads of nickel characterized by surfaces of reoccurring recesses and protrusions, thus providing particles with a relative large external area. The diameter of the coated carrier particles is from about 50 microns to about 1,000 microns, thus allowing these particles to possess sufficient density and inertia to avoid adherance to the electrostatic images during the development process.

The carrier particles are mixed with the toner composition in various suitable combinations, however, best results are obtained with mixtures containing from about 1 part by weight of toner particles to about 5 parts by weight of toner particles, to about 100 parts to 200 parts by weight of carrier particles.

In addition to Xenon flash lamps, other infrared emitting devices can be selected providing they generate energy in the visible and the infrared wavelength region, that is for example, in the wavelengths region of from about 750 nanometers to about 900 nanometers, and preferably from about 800 to about 900 nanometers. Examples of those devices include gallium arsenide lasers.

The quaternary ammonium salts illustrated also function as charge enhancing additives in that they impart positive charges to the toner resin particles, or enhance the positive charges already contained on these particles. Generally, this charge is from about 10 microcoulombs per gram to about 50 microcoulombs per gram, and preferably from about 10 microcoulombs per gram to about 25 microcoulombs per gram. These toner compositions can thus be incorporated into developer compositions useful for rendering visible electrostatic latent images contained in a colored xerographic imaging apparatus wherein the photoreceptor selected is negatively charged.

The toner and developer compositions of the present invention can be used with various electrostatic imaging systems, particularly known single pass xerographic color processes as described in U.S. Pat. No. 4,312,932 the disclosure of which is totally incorporated herein by reference. Examples of photoconductive materials selected for use in these systems include selenium and selenium alloys, halogen doped selenium substances, and halogen doped selenium alloys, as well as organic photoresponsive devices including layered photoreceptor members. As selenium alloys there can be selected selenium arsenic alloys, selenium tellurium alloys, selenium arsenic tellurium alloys, selenium arsenic antimony alloys, and halogen doped alloys, wherein the halogen is a material such as chlorine, present in an amount of from about 50 parts per million to about 500 per million. Examples of layered photoresponsive devices include those containing a substrate, a generating layer, and a transport layer, as disclosed in U.S. Pat. No. 4,265,990, the disclosure of which is totally incorporated herein by reference. Examples of generating layers include trigonal selenium, metal phthalocyanines, metal free phthalocyanines, and vanadyl phthalocyanine, while examples of transport materials include various diamines dispersed in resinous binders. Other organic photoresponsive materials that may be utilized in the practice of the present invention include polyvinyl carbazole, 4-dimethylaminobenzylidene, benzhydrazide; 2-benzylidene-aminocarbazole, (2-nitro-benzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-trinitrofluorenone charge transfer complex; and mixtures thereof.

The toner and developer compositions of the present invention are used to develop color images on various suitable imaging surfaces such as the photoreceptor member as disclosed hereinbefore. Thus, for example, in these systems positive or negative charges can be generated on the photoresponsive surface followed by imagewise exposing the surface for the purpose of forming electrostatic latent images thereon. Subsequently, the image is contacted with the developer of the present invention, followed by transferring the resulting image to a suitable substrate, and permanently affixing the image thereto by flash fusing.

The following examples are now being supplied to further define certain specific embodiments of the present invention, it being noted that these examples are intended to be illustrative only and are not intended to limit the scope of the present invention, parts and percentages are by weight unless otherwise indicated.

EXAMPLE I

There was prepared by melt blending in a Banbury mixing device maintained at 120 degrees Centigrade followed by mechanical attrition, a red toner composition containing 87.6 percent by weight of a styrene n-butyl methacrylate copolymer resin, comprised of 58 percent by weight of styrene, and 42 percent by weight of n-butyl methacrylate, 9.6 percent by weight of Lithol Scarlet red pigment, and 0.8 percent by weight of the magenta pigment 2,9-dimethyl substituted quinacridone, dispersed in a styrene-n-butyl methacrylate copolymer resin in a 50:50 ratio, and 2 percent by weight of the infrared absorbing additive 1,1',3,3,3',3-hexylmethyl-4,4',5,5'-dibenzo-2,2'-indotricarbacene perchlorate. This toner composition was subjected to known micronization techniques and classification procedures so as to result in toner particles having a diameter of from about 5 microns to about 15 microns.

Subsequently, a developer composition was prepared by mixing 3 parts by weight of the above-prepared toner composition, with 100 parts by weight of a carrier comprised of a steel core coated with the fluoropolymer polyvinylidene fluoride in a thickness of 0.2 microns.

The admix charging characteristics of the above-prepared developer composition was then measured in a charge spectrograph, and it was determined that an uncharged fresh toner composition comprised of the same components charged in less than 30 seconds, that is it had an admix charging rate of 30 seconds. While when an identical toner composition that was uncharged and did not contain the perchlorate additive was added to the above-prepared developer composition, admix charging did not occur for about 1 minute as determined by a charge spectrograph or a substantially longer time than when the perchlorate additive is present.

The fusing characteristics of the above-prepared toner composition containing the infrared absorbing additive was then determined by dusting the toner on a sheet of paper, wherein there was generated on the paper an area of toner particles. Subsequently, the paper was placed in a flash fusing test fixture containing a Xenon lamp generating energy of 7.5 joules/inches$^2$ and visual observation after removal from the test fixture indicated the fixing of the toner particles to the paper as repeated finger rubbing did not disrupt the toner particles or cause a smearing thereof. In contrast, when this test was accomplished with an identical toner composition without the perchlorate additive, the toner did not fuse to the paper as determined by visual observation, and further after a single finger rubbing the toner particles became completely detached from the paper substrate.

EXAMPLE II

There was prepared by melt blending followed by mechanical attrition, in accordance with the procedure of Example I, a colored toner composition containing 90 percent by weight of a styrene n-butyl methacrylate copolymer resin (65 percent by weight of styrene, and 35 percent by weight of n-butyl methacrylate), and 10 percent by weight of vanadyl phthalocyanine.

A second toner composition was prepared by repeating the above procedure with the exception that there was selected copper phthalocyanine, in place of the vanadyl phthalocyaine.

Two separately identified developer compositions were then prepared by mixing 3 parts by weight of the above-prepared toner composition with 100 parts by weight of a nickel berry carrier.

The above developer compositions were then incorporated into a xerographic imaging test fixture containing a Xenon lamp therein, and images were generated, developed, and fixed by energy emitted from a Xenon lamp in the wavelength region of about 750 to 850 nanometers.

The resulting images were then submited to the known Taber abrasion test for the purpose of measuring the fixing characteristics of the resulting image and it was determined that a fix energy of 13.00 joules per square inch were required with the developer composition containing copper phthalocyanine, while the fix energy dropped significantly with the developer composition containing vanadyl phthalocyanine, to 8.75 joules per inch squared. This drop in fusing energy requirements indicated that the developer composition with the vanadyl phthalocyanine required less energy for fixing since it was absorbing infrared light.

Moreover, with the toner composition containing the copper phthalocyanine therein, undesirable affluents and odor resulted. However, substantially no odor was detected with the developer containing vanadyl phthalocyanine subsequent to fixing with the Xenon lamp.

EXAMPLE III

There were prepared four different yellow developer compositions by repeating the procedure of Example I. More specifically, there was prepared four yellow toner compositions containing zero (0) percent, 0.25 percent, 0.5 percent, and 1.0 percent, by weight of the infrared absorbing additive tetra-tertiarybutyl vanadyl naphthalocyanine, 5 percent by weight of the yellow pigment 2,5-dimethoxy-4-sulfonoanilide phenylazo-4-chloro-2-5-dimethoxy acetoacetanilide, and about 95 percent by weight of a polyester resin obtained from the reaction product of bis(phenol A), fumaric acid and propylene oxide, reference U.S. Pat. No. 3,590,000, the disclosure of which is totally incorporated herein by reference.

The above toner compositions, 3 parts by weight, were then mixed with 100 parts by weight of carrier particles consisting of an iron powder core coated with a terpolymer of methylmethacrylate, styrene and triethoxy silane.

Electrostatic latent images were then generated and developed with each of the above developer compositions in a Xerox Corporation 3100 imaging machine containing a Xenon lamp therein generating energy in the region of from 750 to 850 nanometers. Subsequent to development, the images were flashed fused with the Xenon lamp and the fixing characteristics of the resulting images were determined on a known Taber Abraser. More specifically, samples of the fixed images were mounted on Taber S-36 specimen mounting cards, and the reflecting density was measured with a Macbeth TR927 densitometer. The mounted samples were then placed on the Model 505 Abraser Teledyne Taber, and abraded for 10 cycles. This abraser was equipped with two Taber Calibrase wheels No. CS-10, and two 1,000 gram weights. The reflection densities were measured for each sample, and plotted against the original unabraded density on the Taber Abraser; and the image fix was determined therefrom.

At a flash fuse energy of 8 joules/inches$^2$ no fixing resulted with the toner composition that contained 0 percent of the vanadyl phthalocyanine infrared absorbing additive in that, for example, no image remained on the paper substrate subsequent to the Taber Abrasion test. In contrast, excellent levels of fix were obtained for the images with the developer composition having incorporated therein 0.25 percent, 0.5 percent and 1.0 percent, of the vanadyl phthalocyanine infrared absorbing additive, when the images were subjected to a flash fusing energy of 8 joules/inches$^2$ in that for example, the images were readily observable and no smearing occurred, subsequent to the Taber Abrasion test.

A blue developer composition was then prepared by repeating the above procedure with the exception that there was selected in place of the yellow pigment, copper tetra-4-(octadecylsulfonomido) phthalocyanine, and in the place of the tetra-tertiarybutyl vanadyl naphthalocyanine, vanadyl phthalocyanine. Thereafter, the developer composition was evaluated for flash fusing by repeating the above procedure and there resulted adequate fixing at a flash fusing energy of 6 joules/inches$^2$, while excellent fixing occurred at 7 joules/inches$^2$ and 8 joules/inches$^2$, indicating that the toner composition involved absorbed energy from the Xenon flash lamp contained in the xerographic imaging test fixture.

Thereafter there was prepared a further blue developer composition by repeating the above procedure with the exception that there was included in the composition in place of the vanadyl phthalocyanine, tetratertiarybutyl vanadyl phthalocyanine. This developer composition was then evaluated for flash fusing with the Taber Abraser test as described herein. With the severe Taber Abrasion test substantially no fixing resulted at flash fusing energies of 6 joules/inches$^2$, 7 joules/inches$^2$, and 8 joules/inches$^2$, however, fixing did result and relatively little smearing occurred when the images were subjected to a finger rubbing in that the image remained on the paper substrate subsequent to four finger rubbings effected within a period of about 5 seconds.

Other modifications of the present invention will occur to those skilled in the art based upon a reading of the present disclosure and these are intended to be included to be within the scope of the present invention.

We claim:

1. An improved infrared sensitive flash fusible colored toner composition consisting essentially of (1) resin particles, (2) pigment particles selected from the group consisting of cyan, magenta, yellow, blue, red and green, and (3) additives selected from the group consisting of vanadyl phthalocyanines, naphthalocyanines, and the quaternary ammonium salts selected from the group consisting of 1,1',3,3,3',3 hexylmethyl-4,4',5,5'-dibenzo-2,2'-indotricarbocyanine perchlorate, 5,5'-dichloro-11-diphenylamine-3,3'-diethyl-10,12-ethylenethiatricarbocyanine perchlorate, 1,1',3,3,3',3'-hexamethylindotricarbocyanine perchlorate, and 3,3'-di(3-acetoxypropyl)-11-diphenylamine-10,12-ethylene-5,6,5',6'-dibenzothiatricarbocyanine perchlorate.

2. An improved composition in accordance with claim 1 wherein the additive is vanadyl phthalocyanine.

3. An improved toner composition in accordance with claim 1 wherein the additive is vanadyl naphthalocyanine or tetra-tertiarybutyl vanadyl naphthalocyanine.

4. An improved toner composition in accordance with claim 3 wherein the tetra-tertiarybutyl vanadyl naphthalocyanine contains from about 1 to about 3 tertiarybutyl groups.

5. An improved toner composition in accordance with claim 1 wherein the quaternary ammonium salt is 1,1',3,3,3',3 hexylmethyl-4,4',5,5'-dibenzo-2,2'-indotricarbocyanine perchlorate, or 5,5'-dichloro-11-diphenylamine-3,3'-diethyl-10,12-ethylenethiatricarbocyanine perchlorate.

6. An improved toner composition in accordance with claim 1 wherein the resin particles are comprised of a styrene n-butyl methacrylate copolymer, a polyester resin, or a styrene butadiene copolymer.

7. An improved toner composition in accordance with claim 1 wherein the pigment particles are selected from cyan, magenta, yellow, or mixtures thereof.

8. An improved toner composition in accordance with claim 7 wherein the cyan pigment is copper tetra-4-(octadecylsulfonomido) phthalocyanine, the magenta pigment is 2,9-dimethyl substituted quinacridone, and the yellow pigment is 2,5-dimethoxy-4-sulfonanilide phenylazo 4-chloro-2,5-dimethoxy acetoacetanilide.

9. A toner composition in accordance with claim 1 wherein the resin particles are present in an amount of from about 80 percent by weight to about 90 percent by weight, the pigment particles are present in an amount of from about 5 percent by weight to about 15 percent by weight, and the additive particles are present in an amount of from about 1 percent by weight to about 20 percent by weight.

10. A developer composition comprised of the toner composition of claim 1 having incorporated therein carrier particles.

11. A developer composition in accordance with claim 10 wherein the resin particles are comprised of a styrene n-butyl methacrylate copolymer, a polyester resin, or a styrene butadiene copolymer.

12. A developer composition in accordance with claim 10 wherein the pigments are selected from cyan, magenta, yellow or mixtures thereof.

13. A developer composition in accordance with claim 12 wherein the cyan pigment is copper tetra-4-(octadecylsulfonomido) phthalocyanine, the magenta pigment is 2,9-dimethyl substituted quinacridone, and the yellow pigment is 2,5-dimethoxy-4-sulfonanilide phenylazo 4-chloro-2,5-dimethoxy acetoacetanilide.

14. A developer composition in accordance with claim 10 wherein the carrier particles are comprised of a core coated with a resinous polymeric composition.

15. A developer composition in accordance with claim 10 wherein the core is steel, and the coating is a fluorocarbon polymer, or a terpolymer of styrene, methylmethacrylate, and a silane.

16. A developer composition in accordance with claim 10 wherein the additive is vanadyl phthalocyanine, vanadyl naphthalocyanine, or a tetra-tertiarybutyl vanadyl naphthalocyanine.

17. A method for developing electrostatic latent images of a desired color which comprises forming an electrostatic latent image on a photoresponsive imaging member, followed by contacting the image with the toner composition of claim 1, subsequently transferring the image to a suitable substrate, and permanently affixing the image thereto with a device generating light of a wavelength in the infrared region of the spectrum.

18. A method of imaging in accordance with claim 17 wherein the fixing device is a Xenon lamp.

19. A method of imaging in accordance with claim 17 wherein the toner composition is comprised of a styrene n-butyl methacrylate copolymer, and a cyan pigment, a magenta pigment, and a yellow pigment, or mixtures thereof.

20. A method of imaging in accordance with claim 17 wherein the additive component is vanadyl phthalocyanine or a tetra-tertiarybutyl vanadyl naphthalocyanine.

21. A method of imaging in accordance with claim 17 wherein the carrier particles are comprised of a core coated with a resinous polymeric composition.

22. A method of imaging in accordance with claim 21 wherein the coating is a fluorocarbon polymer or a terpolymer of styrene, methylmethacrylate and a silane.

23. A method of imaging in accordance with claim 17 wherein the cyan pigment is copper tetra-4-(octadecylsulfonomide) phthalocyanine, the magenta pigment is 2,9-dimethyl substituted quinacridone, and the yellow pigment is 2,5-dimethoxy-4-sulfonanilide phenylazo 4-chloro-2,5-dimethoxy acetoacetanilide.

24. A method of imaging in accordance with claim 17 wherein fixing is accomplished by a flash fusing process.

* * * * *